US006419507B2

(12) United States Patent
Kurimoto

(10) Patent No.: US 6,419,507 B2
(45) Date of Patent: Jul. 16, 2002

(54) CONNECTOR WITH DETECTING UNIT

(75) Inventor: Naoya Kurimoto, Yokkaichi (JP)

(73) Assignee: Sumitomo Wiring Systems, Ltd., Mie (JP)

( * ) Notice: Subject to any disclaimer, the term of this patent is extended or adjusted under 35 U.S.C. 154(b) by 0 days.

(21) Appl. No.: 09/796,645

(22) Filed: Mar. 2, 2001

(30) Foreign Application Priority Data

Mar. 8, 2000 (JP) ..... 2000-063624

(51) Int. Cl.[7] ..... H01R 13/62
(52) U.S. Cl. ..... 439/157
(58) Field of Search ..... 439/489, 157, 439/352

(56) References Cited

U.S. PATENT DOCUMENTS 5,041,017 A * 8/1991 Nakazato et al. ..... 439/509
5,120,255 A 6/1992 Kouda et al.
5,135,410 A * 8/1992 Kawase et al. ..... 439/372
5,749,747 A * 5/1998 Inaba et al. ..... 439/358
5,791,930 A * 8/1998 Tabata et al. ..... 439/345
5,833,484 A * 11/1998 Post et al. ..... 439/352
5,876,230 A 3/1999 Nishide et al.

* cited by examiner

*Primary Examiner*—Brian Sircus
*Assistant Examiner*—Brian S. Webb
(74) *Attorney, Agent, or Firm*—Banner & Witcoff, Ltd.

(57) ABSTRACT

The invention provides fitting detecting means that can be attached to a variety of types of electrical connector. Guiding rails 30 are provided on both ends of a male housing 20, these guiding rails 30 allowing detecting units 40 to be attached. The detecting units 40 have spring holders 41 that house coiled springs 60 and sliders 61. Flange members 31 of the guiding rails 30 are inserted into guide grooves 43 of guiding members 42 formed on inner side faces of the spring holders 41, thereby attaching the detecting units 40 to the female housing 20. The detecting units 40, if required, are attached to the female housing 20 before male and female housings 10 and 20 are fitted together. The sliders 61 of the detecting units 40 are pushed by the male housing 10 while the male and female housings 10 and 20 are being fitted together, this compressing the coiled springs 60 as they are being pushed towards the posterior.

8 Claims, 8 Drawing Sheets

CONNECTOR WITH DETECTING UNIT

TECHNICAL FIELD

The present invention relates to an electrical connector.

BACKGROUND TO THE INVENTION

One example of a connector provided with a means for detecting whether male and female housings are in a half-fitted state is described in JP-9-219257. In this connector, a male housing is provided with a hood into which a female housing can be fitted, and a spring means is housed in a housing member adjacent to the hood. When the two housings are to be fitted together, the spring means is pressed by the female housing, spring force thereof accumulating while it is being pressed. If the fitting operation of the two housings is halted part-way through, the spring force accumulated thus far is released, this pushing the female housing outwards. By this means, the half-fitted state of the two housings can be detected.

The fitting operation of connectors provided with a fitting detecting means is extremely reliable. It is highly desirable to improve the reliability of the fitting operation of connectors in general, and it is therefore desirable to provide a fitting detecting means to connectors which conventionally do not have one. However, it is necessary to design new connectors in order to realize this, and the cost thereof is high.

The present invention has taken the above problem into consideration, and aims to present a fitting detecting means which can be added to a variety of types of connector.

SUMMARY OF THE INVENTION

According to the invention there is provided a connector comprising two mutually engageable connector housings and a detecting unit for detecting incomplete engagement of said housings, said detecting unit being a separate component for selective attachment to one of said housings, and having a spring acted on by the other of said housings and adapted to accumulate a resilient force during engagement of said housings, said force tending to move said housings in the direction of separation. Preferably the other of said housings ceases to act on said spring when the housings are fully engaged, so as to avoid permanent set of the spring.

The detecting unit preferably includes a slider retained therein and resiliently latchable with the other of said housings both in the direction of attachment and in the direction of separation of said housings. In the direction of attachment the slider and other of said housings preferably have contact faces perpendicular to the attachment direction, whereas in the direction of separation the contact faces are preferably at an angle to the attachment direction. Such an arrangement provides a semi-latch which is releasable on application of a predetermined separation force.

In the case of connectors which are elongate in the direction perpendicular to the attachment direction, a detecting unit may be provided at both ends in order to ensure smooth engagement. An attachable detecting unit has the advantage of being able to be included with the connector only when required.

BRIEF DESCRIPTION OF DRAWINGS

Other features of the invention will be apparent from the following description of a preferred embodiment shown by way of example only in the accompanying drawings in which.

DESCRIPTION OF PREFERRED EMBODIMENT

Figure 1:
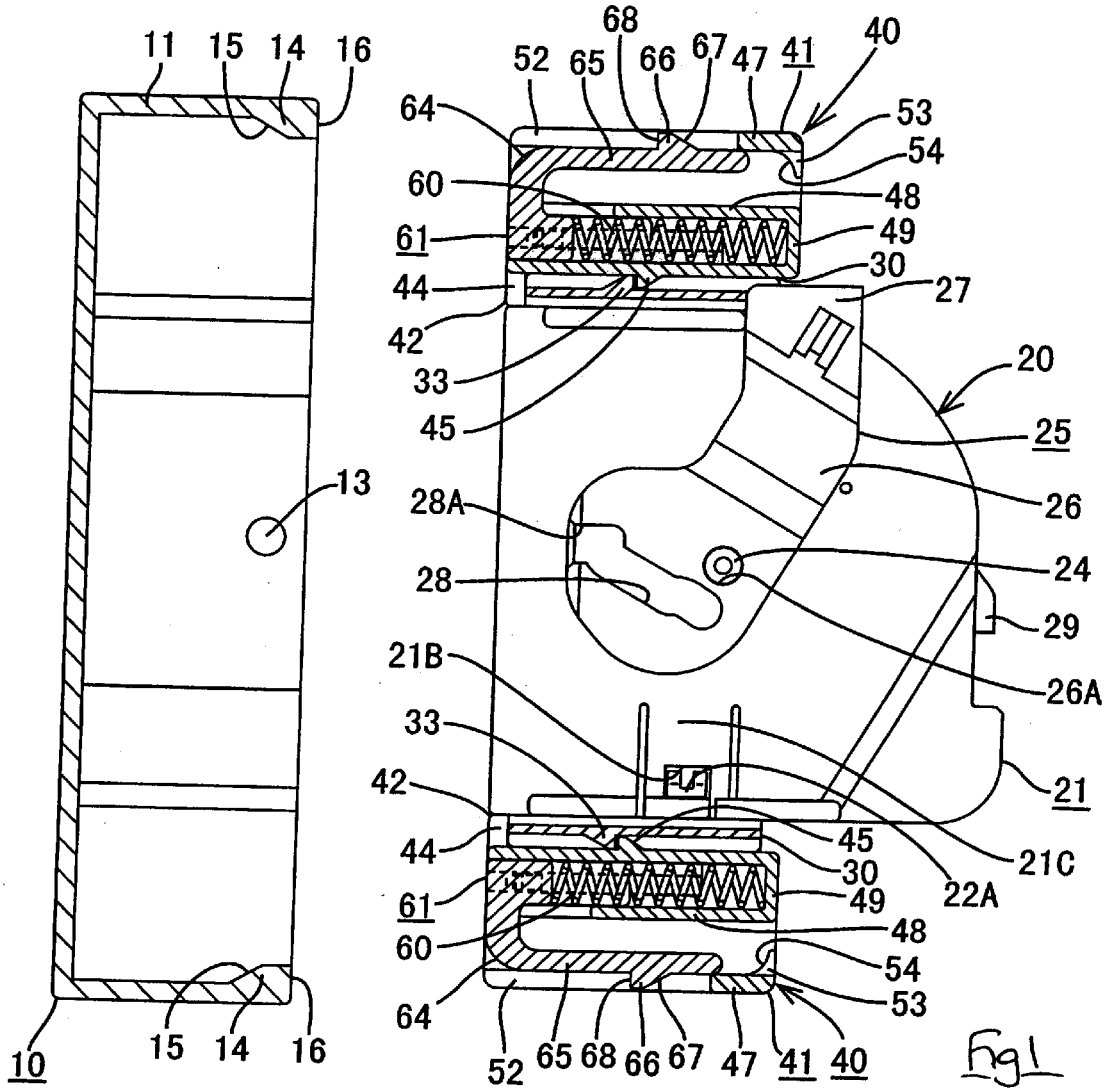
FIG. 1 is a partially cut-away plan view of a connector of an embodiment of the present invention.

An embodiment of the present invention is described below with the aid of FIGS. 1 to 16. This embodiment is a lever-type connector. As shown in FIG. 1, the connector of this embodiment is provided with a male connector housing 10 that fits with a female connector housing 20 provided with a lever 25. Detecting units 40 that function as a fitting detecting means can be attached to the female housing 20. The fitting face sides of the male and female housings 10 and 20 will hereafter be considered as the anterior sides.

Figure 2:
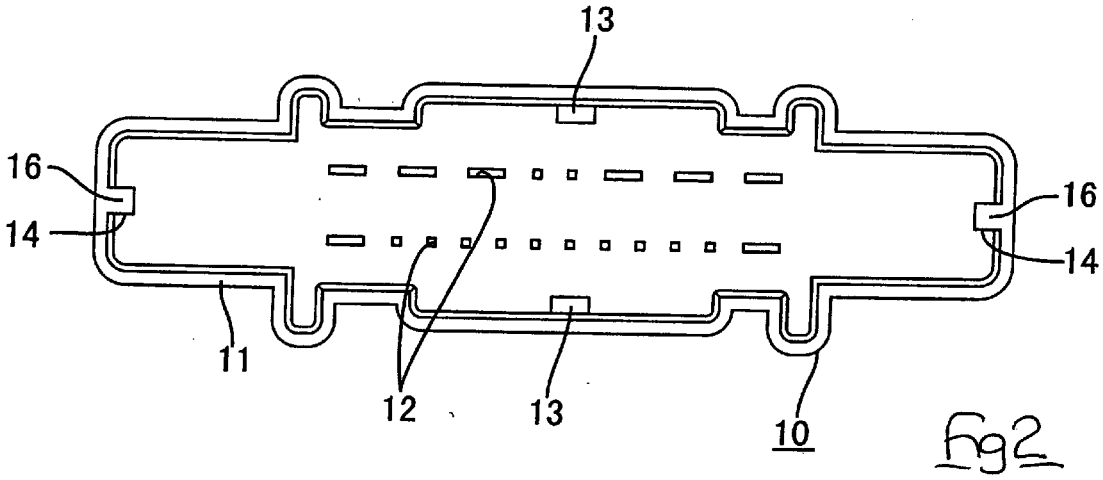
FIG. 2 is a front view of a male housing.

The male housing 10 has a long and narrow shape and is provided with a cylindrical hood 11 that is open to the anterior. As shown in FIG. 2, a plurality of cavities 12 are aligned in two layers within the male housing 10 along the lengthwise direction thereof. Each cavity 12 can have a male terminal fitting (not shown) attached therein. A pair of follower pins 13 protrude from inner faces of the hood 11 at an approximately central location relative to the lengthwise direction of the male housing 10, these follower pins 13 facing one another. The follower pins 13 can be inserted into cam grooves 28 of the lever 25 of the female housing 20 (to be described).

Figure 3:
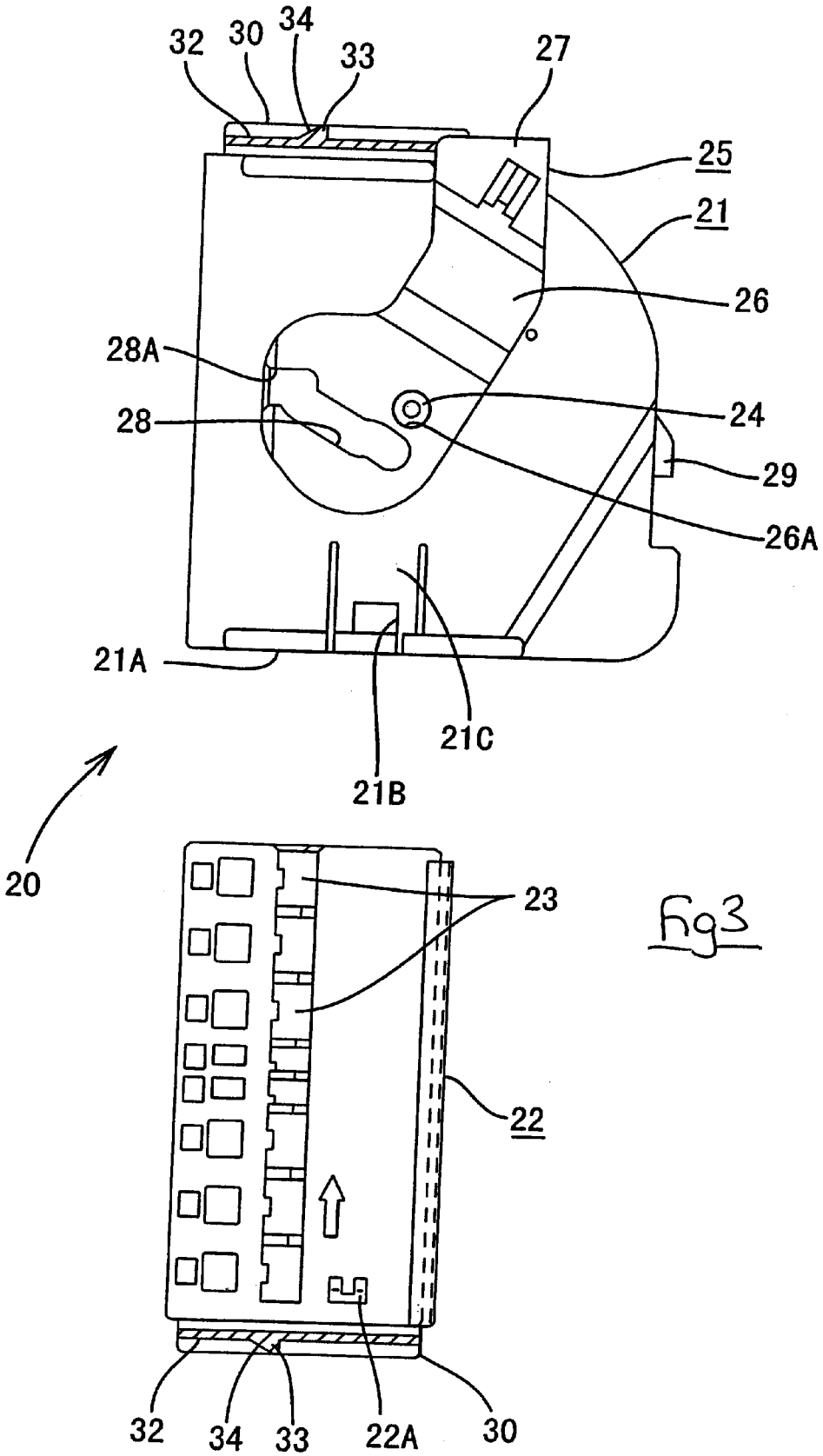
FIG. 3 is a plan view showing a female housing in a disassembled state.
Figure 4:
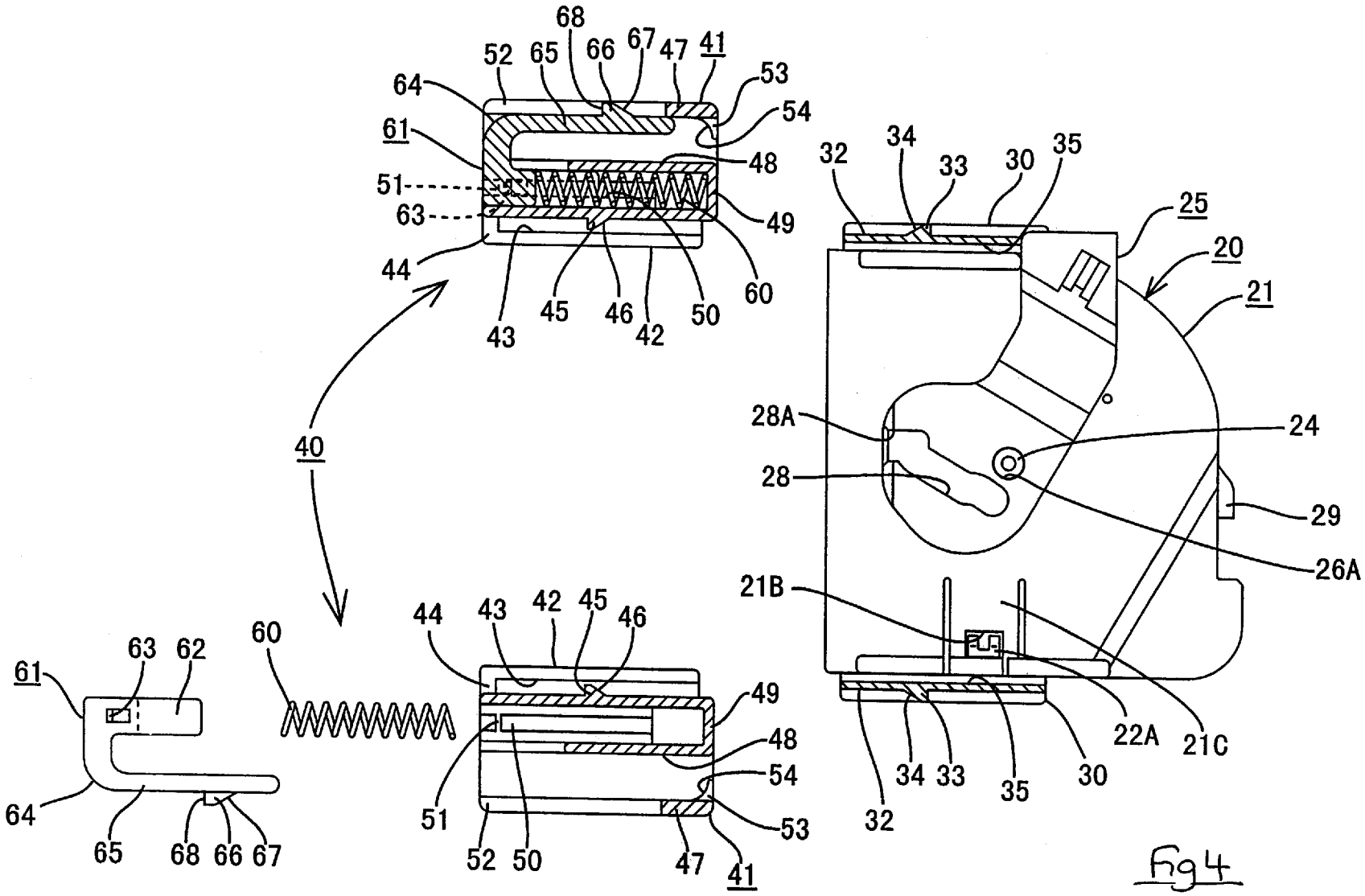
FIG. 4 is a partially cut-away plan view showing the female housing and a detecting unit in a disassembled state.
Figure 5:
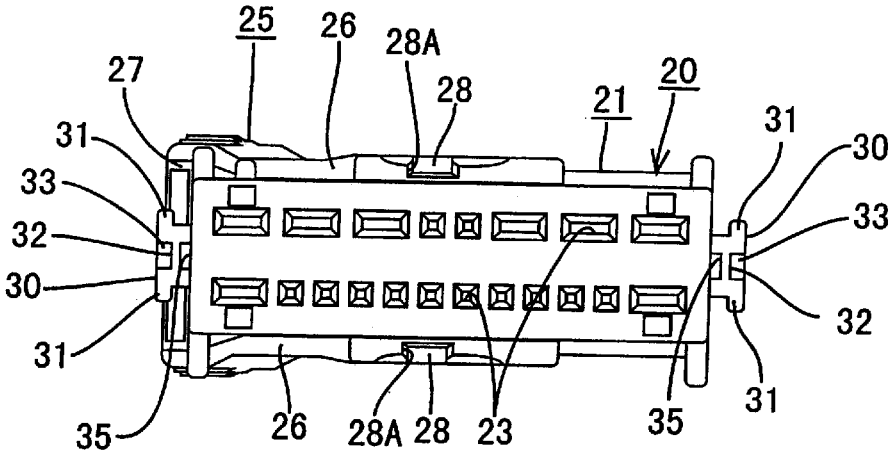
FIG. 5 is a front view of the female housing.

As shown in FIG. 1, the female housing 20 can be fitted into the hood 11 of the male housing 10 and, like the male housing 10, is long and narrow in shape. As shown in FIG. 3, the female housing 20 has a configuration whereby a lower side face (relative to FIG. 3) of an outer housing 21 thereof has an opening 21A, an inner housing 22 being housed within the female housing 20 from this opening 21A (see FIG. 6). As shown in FIGS. 3 and 5, a plurality of cavities 23 are aligned within the inner housing 22, the location of these cavities 23 corresponding to the location of the cavities 12 of the male housing 10. Female terminal fittings are housed within the cavities 23, these female terminal fittings fitting with the male terminal fittings. As shown in FIG. 4, a maintaining arm 21C provided with a retaining hole 21B is provided on a circumference edge of the opening 21A of the outer housing 21. When the inner housing 22 is housed within the outer housing 21, a protrusion 22A formed on the inner housing 22 engages with the retaining hole 21B, thereby maintaining the inner housing 22 in this location.

A pair of axle pins 24, to which the lever 25 is attached, protrude from outer faces of the outer housing 21. The lever 25 has an inverted-U shape and is formed from a pair of foot members 26 joined by a joining member 27. The lever 25 is attached pivotably to the female housing 20 by positioning the two foot members 26 so as to grip the female housing 20 and fitting the axle pins 24 into attachment holes 26A formed in the two foot members 26. The lever 25 can be pivoted along the lengthwise direction of the female housing 20 by pressing the joining member 27, with the axle pins 24 serving as the pivot center.

Figure 7:
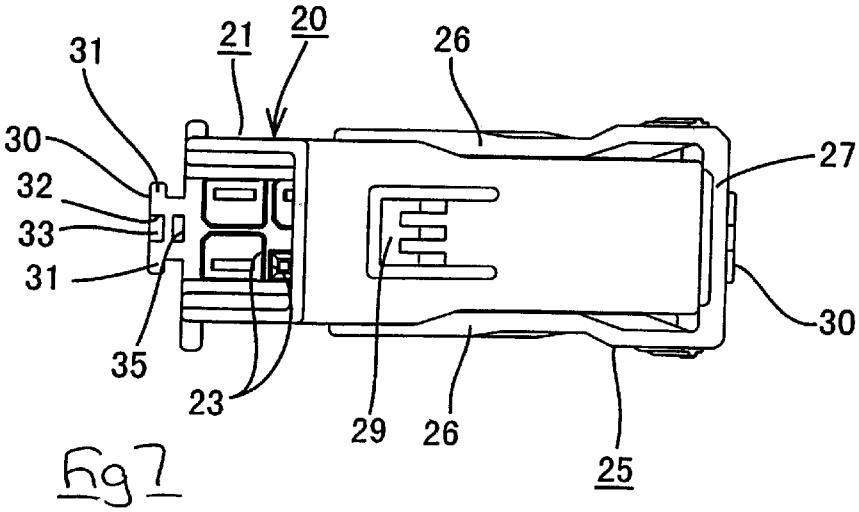
FIG. 7 is a rear face view of the female housing.
Figure 11:
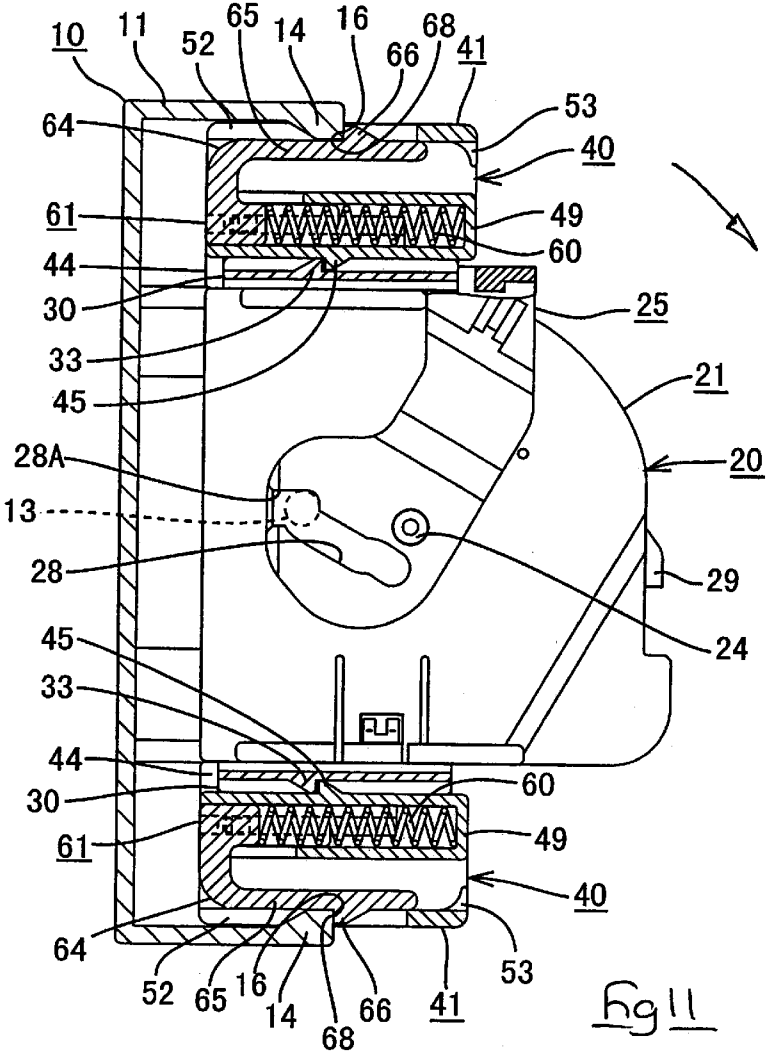
FIG. 11 is a partially cut-away plan view showing the two housings in an early stage of being fitted together.

The cam grooves 28, into which the follower pins 13 of the male housing 10 are inserted, are formed in the two foot members 26. As shown in FIG. 1, when the lever 25 is in a state prior to being pivoted, an entrance hole 28A of each cam groove 28 faces the anterior. As shown in FIG. 11, pivoting the lever 25 after the follower pins 13 have been inserted into the entrance holes 28A of the cam grooves 28 causes the follower pins 13 to move along the cam grooves 28 and causes the male and female housings 10 and 20 to fit together. The male and female housings 10 and 20 reach the correct fitting position when the lever 25 has been pivoted to the position shown in FIG. 14; in this position, an end of the joining member 27 thereof is retained by a stopping member 29 provided on the female housing 20. As shown in FIG. 7, the stopping member 29 has a cantilevered shape and is capable of bending resiliently into the female housing 20.

Guiding rails 30 protrude from an innermost side face (relative to FIG. 3) of the outer housing 21 and from an outermost side face of the inner housing 22. That is, as shown in FIG. 4, these guiding rails 30 are provided at both lengthwise ends of the female housing 20, and allow the detecting units 40 to be attached. Each detecting unit 40 has a configuration whereby a coiled spring 60 and a slider 61 are housed within a spring holder 41. The detecting units 40 are attached by fitting guiding members 42, which are provided on the spring holders 41, into the guiding rails 30 of the female housing 20 (see FIG. 10).

Figure 6:
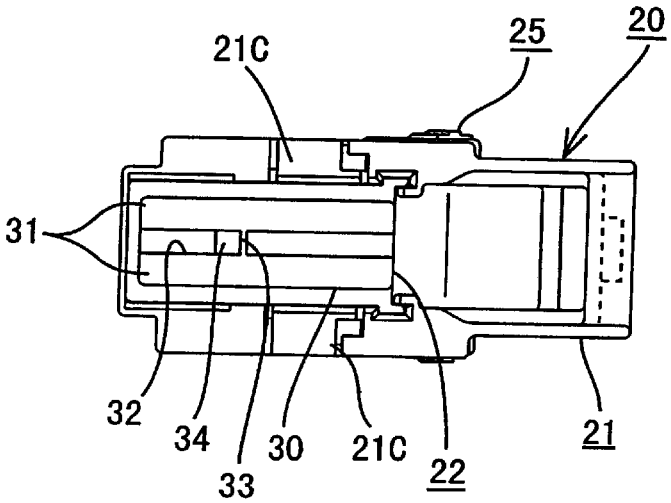
FIG. 6 is a side face view of the female housing.

The attachment configuration of the female housing 20 and the detecting units 40 will now be explained. As shown in FIG. 4, the guiding rails 30 extend in a lengthwise direction along side faces of the female housing 20 and, as shown in FIG. 5, a pair of flange members 31 protrude in a T-shape upwards and downwards from these guiding rails 30. As shown in FIG. 6, the guiding rails 30 extend from a location slightly back from an anterior end of the female housing 20 to a posterior end of this female housing 20.

As shown in FIG. 4, the spring holders 41 are attached along the guiding rails 30 from the anterior of the female housing 20. The pair of guiding members 42 protrude from both side edges of a lower face (relative to FIG. 8) of each spring holder 41. Guide grooves 43 are formed in inner edges of the guiding members 42, the flange members 31 of the guiding rails 30 being inserted therein. As shown in FIG. 4, protruding members 44 are formed at anterior ends of the guide grooves 43. As shown in FIG. 1, when the spring holders 41 have been attached to the female housings 20, the protruding members 44 engage with anterior ends of the flange members 31 of the guiding rails 30, thereby preventing the spring holders 41 from moving any further towards the posterior.

As shown in FIG. 6, a groove 32 extends along the entire length of an outer face of each guiding rail 30, at a location approximately half-way up this outer face. As shown in FIG. 4, a catching protrusion 33 is provided at a location slightly to the anterior of the center (relative to the lengthwise direction) of the groove 32. A stopping protrusion 45 is formed at a central location (relative to the widthwise direction) of a lower face (relative to FIG. 8) of each spring holder 41. When the spring holders 41 are inserted into the grooves 32 of the guiding rails 30, the stopping protrusions 45 engage with the catching protrusions 33. As shown in FIG. 4, the stopping protrusions 45 are formed at an approximately central location relative to the lengthwise direction of the spring holders 41.

Tapering guiding faces 34 and 46 are formed on anterior faces of the catching protrusions 33 and posterior faces of the stopping protrusions 45 respectively. When the spring holders 41 are inserted into the grooves 32 while they are being attached, the guiding faces 34 and 46 guide the stopping protrusions 45 over the catching protrusions 33. As shown in FIG. 1, when the spring holders 41 have been attached to the female housing 20, the stopping protrusions 45 are located directly to the posterior of the catching protrusions 33, perpendicular faces of the two engaging with one another. By this means, the spring holders 41 are prevented from moving towards the anterior. At this juncture, as described above, the protruding members 44 engage with the anterior ends of the guiding rails 30. Consequently, the detecting units 40 are maintained in a state where they cannot move towards the anterior or the posterior relative to the female housing 20. Furthermore, as shown in FIG. 5, a recess 35 passes from the anterior to the posterior of each guiding rail 30 at a location inwards from the groove 32 and separated therefrom by a wall. These recesses 35 allow the walls of the guiding rails 30 to bend temporarily when the stopping protrusions 45 pass over the catching protrusions.

Next, the configuration of the detecting units 40 will be described in detail. As shown in FIG. 4, the spring holders 41 have an approximately angular cylindrical shape that is open to the anterior. The coiled springs 60 and then the sliders 61 are housed within these spring holders 41, being inserted from the anterior via the opening portions thereof. The sliders 61 are capable of moving in an anterior-posterior direction within the spring holders 41 along the fitting direction of the male and female housings 10 and 20.

The spring holders 41 have outer walls 47 formed opposite the faces that are attached to the female housing 20, and inner walls 48 are provided therebetween. Spaces between the inner sides of the inner walls 48 house the coiled springs 60, and spring receiving walls 49 that restrain posterior ends of the coiled springs 60 are provided at the posterior ends of the inner walls 48. When the sliders 61 are moved to the posterior, these spring receiving walls 49 allow the coiled springs 60 to be compressed, the spring force thereof accumulating. When the sliders 61 are attached in the position shown at the top of FIG. 4, the coiled springs 60 are slightly compressed, and this results in the sliders 61 being kept positioned towards the anterior.

Figure 8:
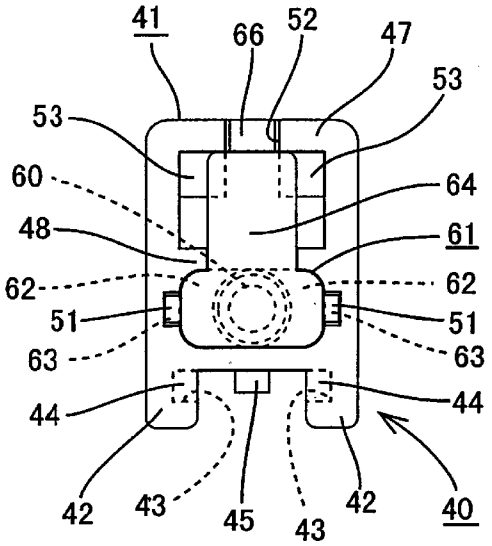
FIG. 8 is a front view of the detecting unit.

As shown in FIG. 8, the coiled springs 60 make contact with the center (relative to the widthwise direction thereof) of the sliders 61. Forked holders 62, these maintaining the centrally located coiled springs 60 in a gripped state, are located at both edges relative to the widthwise direction of the sliders 61 and extend towards the posterior. A pair of protrusions 63 are formed on both side faces of the sliders 61. As shown in FIG. 4, these protrusions 63 enter a pair of guiding grooves 50 formed in inner faces of the spring holders 41 and slide along these guiding grooves 50, thereby guiding the movement of the sliders 61 in the anterior-posterior direction. Stoppers 51 are formed at anterior ends of the guiding grooves 50. The protrusions 63 engage with these stoppers 51, thereby retaining the sliders 61 in the anterior direction. When the sliders 61 are in the position shown at the top of FIG. 4, the protrusions 63 are in an engaged state with the stoppers 51.

As shown in FIG. 4, cantilever shaped locking arms 64 protrude outwards from anterior end portions of side faces of the sliders 61, these side faces extending along the inner walls 48 of the spring holders 41. Anterior portions of the inner walls 48 are cut away so as to allow the locking arms 64 to enter therein. The locking arms 64 are provided with arms 65 that extend from base members outwards the posterior and can be bent along the lengthwise direction of the female housing 20 with the base members serving as the bending bases. The arms 65 extend along the outer walls 47. Bending the locking arms 64 causes the arms 65 to move inwards or outwards (see FIG. 12).

Figure 14:
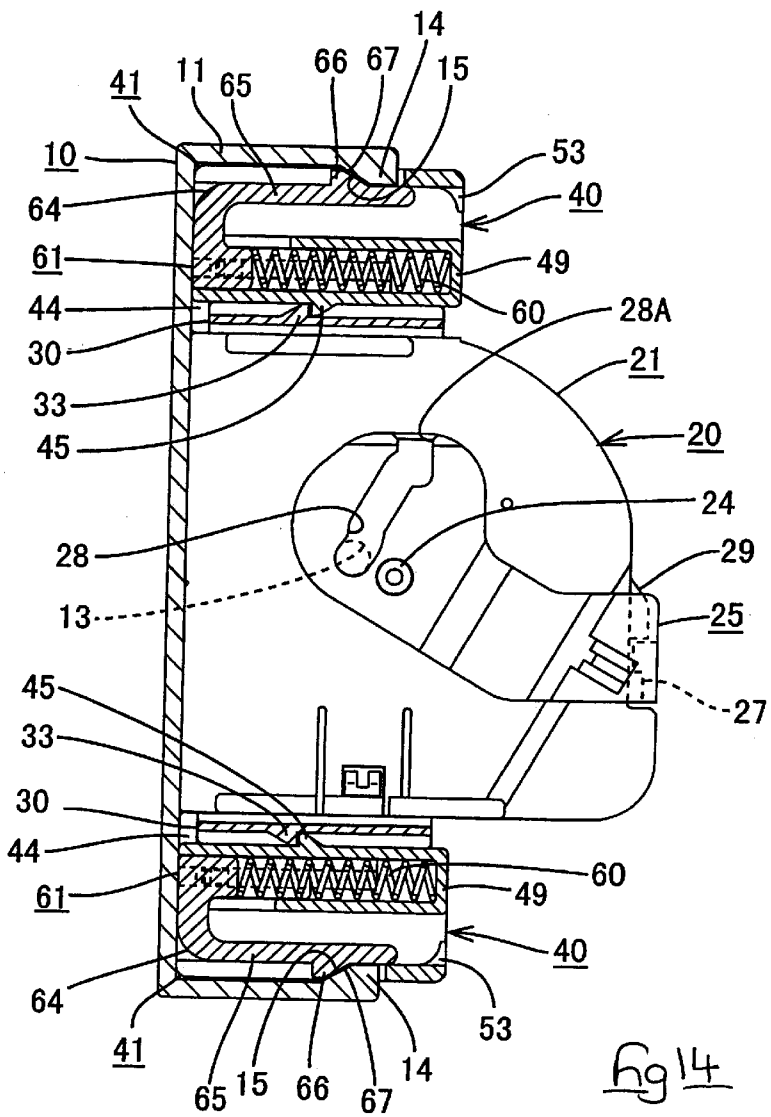
FIG. 14 is a partially cut-away plan view showing the two housings correctly fitted together.

The side faces of the arms 65 that extend along the outer walls 47 are provided with outwardly protruding locking protrusions 66. These locking protrusions 66 are located posteriorly with respect to the center (relative to the lengthwise direction thereof) of the arms 65. Recessed grooves 52, into which the locking protrusions 66 enter, are formed in the outer walls 47. These recessed grooves 52 are provided along a specified distance from the anterior ends of the outer walls 47 and are open at the anterior. As shown in FIGS. 1 and 2, locking members 14 protrude inwards at the anterior end of the hood 11 of the male housing 10. The locking protrusions 66 of the locking arms 64 engage with these locking members 14. A tapered face 15 is formed on a posterior end face of each locking member 14, this tapered face 15 joining with the inner face of the hood 11 and being gently inclined. A tapered face 67 is provided on a posterior face of each locking protrusion 66 and is inclined at the same angle as the tapered faces 15. These tapered faces 15 and 67 mutually engage. As shown in FIG. 14, if a pulling force exceeding a specified degree is exerted on the mutually engaged locking arms 64 and locking members 14 so as to move the male and female housings 10 and 20 in a direction of separation, the locking arms 64 bend while being guided by the tapered faces 15 and 67, and their engaged state with the locking members 14 is released. That is, the tapered faces 15 and 67 form a semi-locking configuration.

As shown in FIG. 11, while the male and female housings 10 and 20 are being fitted together, the locking members 14 of the male housing 10 enter the recessed grooves 52 in the outer walls 47 of the spring holders 41, and strike against anterior faces of the locking protrusions 66. When the locking members 14 are in an inserted state within the recessed grooves 52, inner faces of these locking members 14 form approximately unified faces with inner faces of the outer walls 47. Anterior faces of the locking members 14 are at right angles to the fitting direction of the male and female housings 10 and 20, these faces forming pushing members 16 that correspond to the locking protrusions 66. The anterior faces of the locking protrusions 66, like the pushing members 16, are at right angles to the fitting direction of the male and female housings 10 and 20. These anterior faces form pushing receiving members 68 that receive the pushing force from the pushing members 16. Performing the fitting operation of the male and female housings 10 and 20 while the pushing members 16 make contact with the pushing receiving members 68 causes an increased pushing force to be exerted on the pushing receiving members 68, thereby pushing the sliders 61 to the posterior and compressing the coiled springs 60.

As shown in FIGS. 4 and 8, a pair of movable guiding members 53 is provided at the posterior end of side walls of each spring holder 41. These movable guiding members 53 adjoin the outer walls 47 at the side faces of the spring holders 41 and protrude to a location where they form approximately unified faces with edges of the recessed grooves 52. As shown in FIG. 4, anterior faces of the movable guiding members 53 form arc-shaped faces 54. Posterior end portions of the arms 65 of the locking arms 64 engage with these arc-shaped faces 54. When the sliders 61 are moved towards the posterior while the posterior end portions of the arms 65 are engaged with the arc-shaped faces 54, the locking arms 64 bend inwards as they are guided by the arc-shaped faces 54. The posterior end portions of the arms 65 of the locking arms 64 are rounded so as to be semicircular in shape.

The present embodiment is configured as described above. Next, the operation thereof will be explained. This connector is formed from the separate components of the male and female housings 10 and 20 and the detecting units 40. Consequently, before performing the fitting operation of the male and female housings 10 and 20, it must first be decided whether the fitting detecting means will be required, and consequently whether the detecting units 40 should be attached.

In the case where fitting detecting is not required, the lever 25 is operated to fit the female housing 20 with the male housing 10 with the detecting units 40 in an unattached state with the female housing 20 (see FIG. 4).

In the case where fitting detecting is required, the detecting units 40 are first attached to the female housing 20, and then the fitting operation of the male and female housings 10 and 20 is performed.

Figure 9:
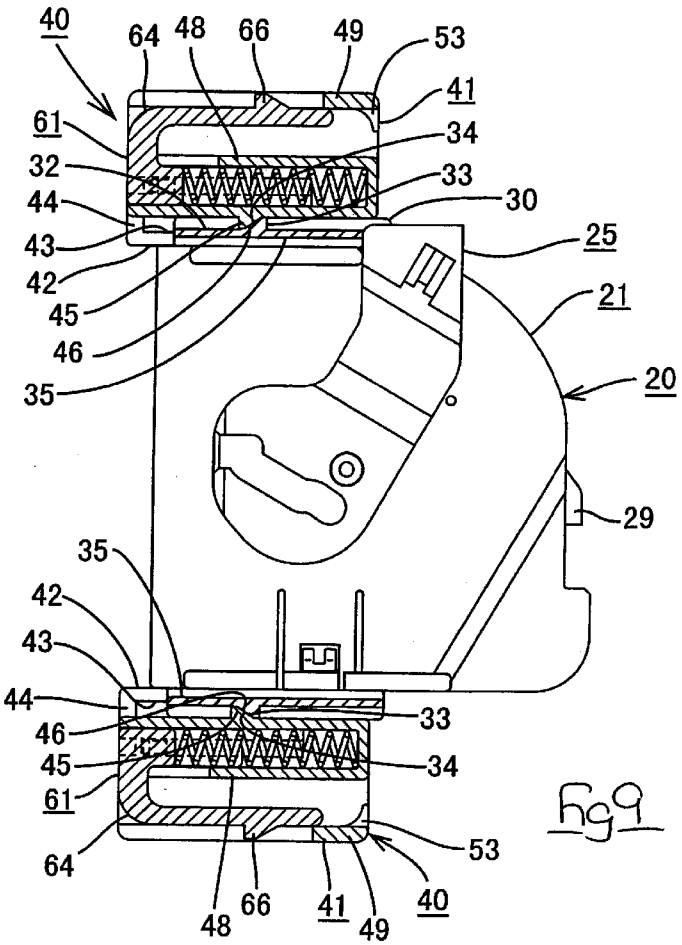
FIG. 9 is a partially cut-away plan view showing the detecting units being attached to the female housing.
Figure 10:
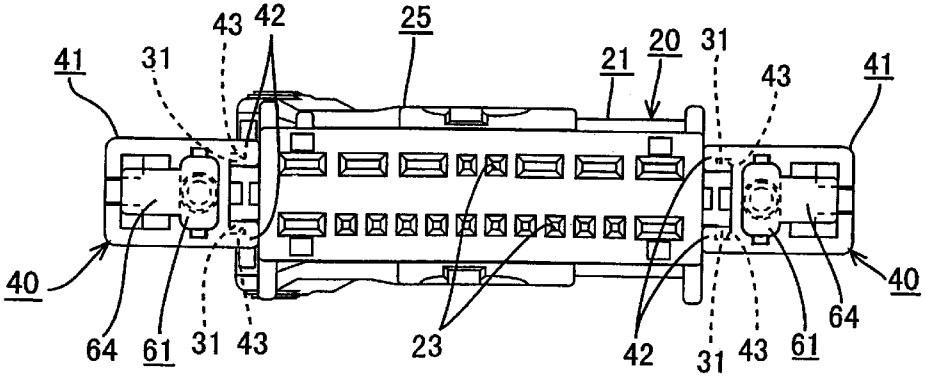
FIG. 10 is a front view showing the detecting units attached to the female housing.

As shown in FIG. 4, the detecting units 40 are attached to the female housing 20 as follows: the flange members 31 of the guiding rails 30 are fitted from the anterior of the female housing 20 into the guide grooves 43 of the spring holders 41, and the detecting units 40 are pushed in towards the posterior. As the detecting units 40 are being pushed towards the posterior along the guiding rails 30, the stopping protrusions 45 enter the grooves 32. Then, as shown in FIG. 9, the guiding faces 34 and 46 of the catching protrusions 33 and the stopping protrusions 45 (the guiding faces 34 and 46 having been in a state whereby they were making mutual contact) guide one another to bring the stopping protrusions 45 over the catching protrusions 33 while the detecting units 40 are being moved further towards the posterior. After this, as shown in FIG. 1, the stopping protrusions 45 are located directly to the posterior of the catching protrusions 33 within the grooves 32, these catching protrusions 33 retaining the stopping protrusions 45. By this means, the detecting units 40 are prevented from moving to the anterior relative to the female housing 20. At this juncture, the protruding members 44 of the spring holders 41 are engaged with the anterior ends of the flange members 31 of the guiding rails 30, thereby preventing the detecting units 40 from moving any further towards the posterior. That is, the detecting units 40 are attached to the female housing 20 in a state whereby they cannot move to the anterior or the posterior. Furthermore, as shown in FIG. 10, the guiding rails 30 are fitted into the guide grooves 43, thereby preventing the detecting units 40 from moving in a widthwise direction.

Next, the female housing 20, having the detecting units 40 attached thereto, is fitted to the male housing 10. As shown in FIG. 11, the female housing 20 is inserted into the hood 11 of the male housing 10, the follower pins 13 fitting lightly within the entrance holes 28A of the cam grooves 28 of the lever 25. At this juncture, the pushing members 16 of the male housing 10 make contact with the pushing receiving members 68 of the locking protrusions 66. The lever 25 is then pivoted in the direction shown by the arrow.

Figure 12:
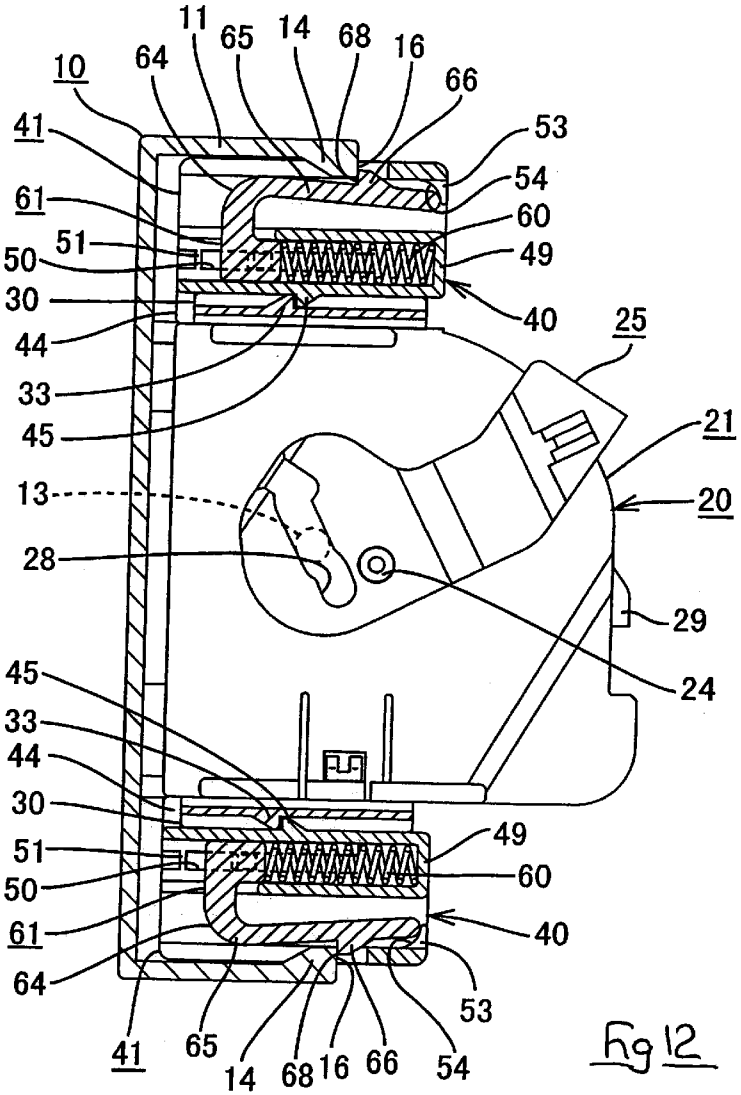
FIG. 12 is a partially cut-away plan view showing the two housings being fitted together.

While the lever 25 is being pivoted, the follower pins 13 move inwards along the cam grooves 28 and the male and female housings 10 and 20 are brought closer together in the fitting direction (see FIG. 12). The pushing receiving members 68 receive a greater pushing force from the pushing members 16 while the fitting of the male and female housings 10 and 20 progresses, this pushing force pushing the sliders 61 towards the posterior and compressing the coiled springs 60. While the lever 25 is pivoted further from the state where the posterior end portions of the arms 65 of the locking arms 64 make contact with the arc-shaped faces 54 of the movable guiding members 53, the sliders 61 move further towards the posterior, the posterior end portions of the arms 65 being guided by the arc-shaped faces 54 of the movable guiding members 53 and the locking arms 64 bending inwards. As the locking arms 64 bend, the arms 65 provided with the locking protrusions 66 bend inwards, thereby causing the engagement of the pushing receiving members 68 with the pushing members 16 to gradually decrease.

If the pivoting of the lever 25 is halted while the male and female housings 10 and 20 are partly fitted together, the accumulated spring force of the coiled springs 60 is released, thereby separating the male and female housings 10 and 20. By this means it can be ascertained that the male and female housings 10 and 20 were partly fitted together. The coiled springs 60 are provided at both lengthwise ends of the male and female housings 10 and 20. Consequently, the partly fitted housings 10 and 20 separate smoothly from one another.

Figure 13:
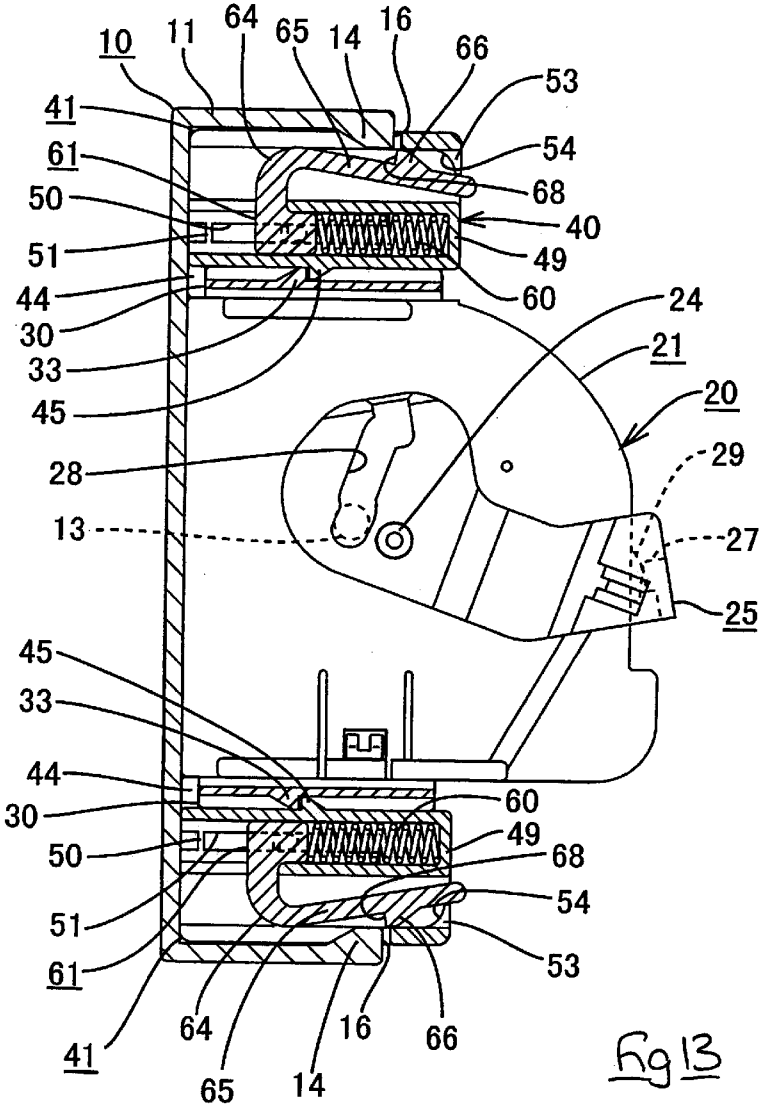
FIG. 13 is a partially cut-away plan view showing the two housings immediately prior to reaching the correct fitting position.
Figure 15:
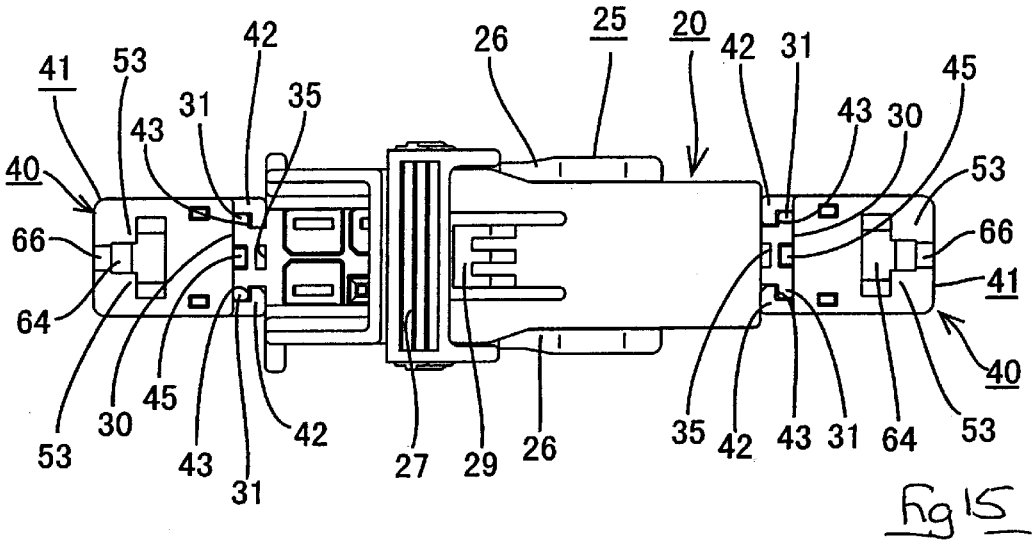
FIG. 15 is a rear face view showing the two housings correctly fitted together.
Figure 16:
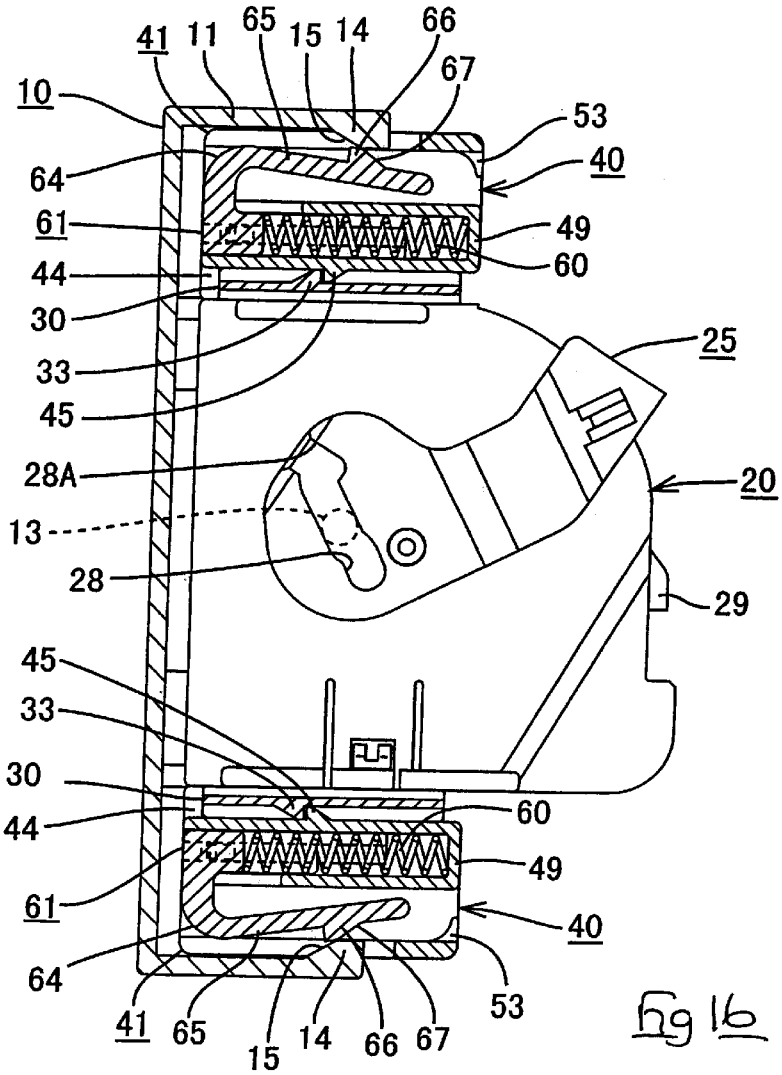
FIG. 16 is a partially cut-away plan view showing the two housings being separated.

When the sliders 61 reach the position shown in FIG. 13, the locking arms 64 are bent to a position whereby the pushing receiving members 68 are completely released from being pushed by the pushing members 16. At this juncture, the posterior end portions of the arms 65 are no longer guided by the arc-shaped faces 54 of the movable guiding members 53, inner edges of the movable guiding members 53 face the outer faces of the arms 65, and the posterior end portions of the arms 65 protrude out from the posterior of the spring holders 41.

The spring force of the compressed coiled springs 60 is released as the pushing state of the pushing members 16 and the pushing receiving members 68 is released, pushing the sliders 61 to the anterior. This forward movement of the sliders 61 is guided by the protrusions 63 sliding within the guiding grooves 50. While the sliders 61 are moving to the anterior, the locking arms 64, while remaining in a bent state, move so as to pass along the locking members 14 of the male housing 10. Then, as shown in FIG. 14, the sliders 61 return to their original position and the locking arms 64 return to their original position, the tapered faces 67 of the locking protrusions 66 being retained by the tapered faces 15 of the locking members 14. At this juncture, the protrusions 63 of the sliders 61 engage with the stoppers 51, thereby preventing the sliders 61 from moving any further towards the anterior. Furthermore, the coiled springs 60 have regained their original length (their length prior to fitting), thereby avoiding set-in fatigue.

At approximately the same time, the joining members 27 of the lever 25 causes the stopping member 29 to bend resiliently, and the joining member 27 rises over it (see FIG. 13). When the lever 25 is pivoted to the position shown in FIG. 14, it is retained by the stopping member 29 which has returned to the end of the joining member 27 (see FIG. 15). By this means, the lever 25 is maintained in a locked state. At this juncture, the male and female housings 10 and 20 are at the correct fitting depth (see FIG. 14). The lever 25 is retained by the stopping member 29 while the follower pins 13 are in a fitting state within the cam grooves 28, and the locking arms 64 provided at both lengthwise ends of the male and female housings 10 and 20 are retained by the locking members 14, this maintaining the male and female housings 10 and 20 in a correct fitting state. In this manner, both lengthwise ends of the male and female housings 10 and 20 are maintained and, while the male and female housings 10 and 20 are in the fitting state, instability and slippage to the anterior or posterior, relative to the lengthwise direction thereof, is prevented.

If the male and female housings 10 and 20 are to be separated for maintenance or the like, the joining member 27 of the lever 25 is released from this retained state while the stopping member 29 is bent, then the lever 25 is pivoted in the opposite direction to which it was first rotated. While the lever 25 is being pivoted, the follower pins 13 move along the cam grooves 28 to the entrance holes 28A and the male and female housings 10 and 20 are moved in a direction of separation. At this juncture, the locking arms 64 are guided inwards from their retained state with the locking members 14 as the pulling force increases, being guided by the tapered faces 15 and 67 that fit mutually together, and as they bend these locking arms 64 are released from their retained state with the locking members 14 (see FIG. 16). By this means, the male and female housings 10 and 20 are released from the retained state and can be separated by pivoting the lever 25 further. The locking arms 64 and the locking members 14 form the semi-locking configuration, and consequently their retained state is released automatically by pivoting the lever 25.

In the embodiment described above, the detecting units 40 are formed as a component separate from the male and female housings 10 and 20. Consequently, the detecting means can easily be added when it is required for the connector. Furthermore, the detecting units 40 are provided at both lengthwise ends of the long and narrow connector. As a result, fitting resistance at either lengthwise end is prevented when the male and female housings 10 and 20 are fitted together, and the male and female housings 10 and 20 can also be separated smoothly.

The detecting units 40 are provided with retaining devices. Consequently, the male and female housings 10 and 20 that have been fitted together can be maintained in a stable state. Furthermore, the retaining devices of the detecting units 40 have semi-locking devices. Consequently, the lever 25 merely needs to be pivoted from its retained state in order to easily separate the male and female housings 10 and 20.

In the embodiment described above, the detecting unit is attached to a lever-type connector. However, the detecting unit may be attached to other types of connectors as well if the connectors have an attachment configuration for the detecting units. For example, the detecting unit may be optionally attached to a connector wherein a locking arm is provided in the central portion (relative to the widthwise direction) of a female housing, this locking arm engaging with a locking member provided on a male housing. That is, the same detecting unit may be attached to various types of connector if the connectors have a common attachment configuration; this increases the universality of the detecting unit. Consequently, the detecting unit can be produced in bulk, and the production costs thereof will decrease.

The present invention is not limited to the embodiments described above with the aid of figures. For example, the possibilities described below also lie within the technical range of the present invention. In addition, the present invention may be embodied in various other ways without deviating from the scope thereof.

(1) In the embodiment described above, the retaining devices of the detecting units have a semi-locking configuration. However, in the case where the male and female housings are to be maintained more stably in the fitting state, a conventional locking configuration may be employed within perpendicular faces engage with one another.

(2) In the embodiment described above, the detecting unit is provided with the retaining devices. However, these retaining device may be omitted in the case where locking performed by the lever alone is adequate.

(3) In the embodiment described above, the pair of detecting units are attached to both lengthwise ends of the female housing. However, in the case where the connector to which the detecting unit will be fitted has a different shape, one detecting unit, or three or more detecting units may be attached thereto.

(4) The detecting units may be attached to the male housing rather than the female housing.

What is claimed is:

1. A connector comprising two mutually engageable connector housings and a detecting unit for detecting incomplete engagement of said housings, said detecting unit being a separate component for selective attachment to one of said housings, and having a spring acted on by the other of said housings during fitting of the housings together such that the spring accumulates a resilient force as said housings are fit together, said force tending to move said housings in the direction of separation, the other of said housings ceases to act on said spring on complete engagement of said housings, thereby releasing spring force accumulated during engagement of said housings;

said detecting unit comprises a body, a compression spring housed in said body, and a slider movable in said body to compress said spring, said slider having a resilient cantilever arm and an abutment on said arm engageable by the other of said housings during engagement of said housing, and means to disengage said abutment from the other of said housings on complete engagement of said housings;

wherein said body includes a ramp adapted to bend said arm during engagement of said housings, to permit disengagement of said abutment from the other of said housings on full engagement thereof, the ramp comprises an arc-shaped face of the body, and the end of the resilient cantilever arm is rounded and engages the arc-shaped face during engagement of the housings to bend the arm inwardly.

2. A connector according to claim 1, wherein said abutment comprises a protrusion having a front face perpendicular to the attachment direction of said housings, and for engagement by the other of said housings during engagement of said housings, and a back face angled with respect to said attachment direction.

3. A connector according to claim 1, wherein said one of said housings has an external attachment rail having a 'T' section and extending in the attachment direction of said housings, and said detecting unit has an elongate 'T' section socket open at one end to receive said rail, the other end of said socket having an abutment engageable with said rail, wherein said rail and socket have a resilient latch engageable to maintain said rail against said abutment.

4. A connector according to claim 3 wherein said resilient latch includes a projection of said detecting unit and slidable in a groove of said rail, said projection being engageable with an obstruction of said groove.

5. A connector according to claim 1, and being elongate in a direction perpendicular to the attachment direction of said housings, a detecting unit being provided at each end of said one of said housings.

6. A connector according to claim 1, wherein said detecting unit latches the other of said housings on complete engagement of said housings.

7. A connector according to claim 6 and having a lever on one of said housings, said lever being engageable with the other of said housings and pivotable to draw said housings into complete engagement, said detecting unit being disengaged from the other of said housings on application of a force to said lever in a disengaging direction, said force exceeding a predetermined limit.

8. A connector in accordance with claim 1, wherein the detecting unit and said one housing include complementary latching structures that are engaged prior to the fitting of the two housings together.

* * * * *